United States Patent [19]

Coda

[11] Patent Number: 4,716,670

[45] Date of Patent: Jan. 5, 1988

[54] DISPLAY STAND

[76] Inventor: Alfred Coda, 48 Wyandemere Dr., Woodcliff Lake, N.J. 07675

[21] Appl. No.: 879,579

[22] Filed: Jun. 27, 1986

[51] Int. Cl.[4] ..... G09F 1/06; G09F 21/04

[52] U.S. Cl. ..... 40/152.1; 40/124.1

[58] Field of Search ..... 40/152.1, 124.1; 206/44 R, 44 B

[56] References Cited

U.S. PATENT DOCUMENTS

| | | | |
|---|---|---|---|
| 1,404,579 | 1/1922 | Chilcote | 40/152.1 |
| 1,532,290 | 4/1925 | Wilson | 40/124.1 |
| 1,576,636 | 3/1926 | Egan | 40/124.1 |
| 2,181,164 | 11/1939 | Alexander | 52/631 |
| 2,784,929 | 3/1957 | Diening | 40/124.1 |
| 3,534,491 | 10/1970 | Girard | 40/124.1 |
| 4,062,139 | 12/1977 | Klösel | 40/124.1 |
| 4,322,926 | 4/1982 | Wöflingseder | 52/631 |

*Primary Examiner*—Henry E. Raduazo

*Attorney, Agent, or Firm*—Samuelson & Jacob

[57] ABSTRACT

A display stand for displaying a card-like item, such as a photograph, is erected from a unitary sheet member bent to form a base and walls extending upwardly from the base and forwardly over the base so that one end of the sheet member is tucked behind a shoulder at the other end of the sheet member and is biased resiliently toward the shoulder to grip the item between the one end and the shoulder and hold the item upright, relative to the base, for display.

20 Claims, 6 Drawing Figures

DISPLAY STAND

The present invention relates generally to the display of card-like items, such as pictures, signs, plaques and like items, and pertains, more specifically, to a display stand capable of being shipped and stored in a relatively flat and compact configuration and readily erected to a display configuration.

A wide variety of display stands currently are available for the display of card-like items on table-tops, counter-tops and similar horizontal surfaces where pictures, signs, plaques and other such items are placed on view. For example, it is quite common to display a photograph, or a grouping of photographs, on a table, a desk, a credenza or another piece and it would be advantageous to have available a simple, relatively inexpensive and unobtrusive display stand for such a use.

It is an object of the present invention to provide a display stand of the type described and which is capable of being shipped and stored in a relatively flat configuration, preferably in one piece, for ease of handling, yet is erected readily, without requiring tools or special skills, to provide a sturdy and stable stand for a wide variety of items to be displayed.

Another object of the invention is to provide a display stand of the type described and which is versatile enough to be used in connection with many different items, and which enables the display of these items in selected orientations, as in the case of photographs which can be displayed either in a vertical or a horizontal attitude.

Still another object of the invention is to provide a display stand of the type described and which is unobtrusive in use so as not to detract from the item being displayed.

Yet another object of the invention is to provide a display stand of the type described and which is easily and inexpensively manufactured in large numbers of consistent high quality.

The above objects, as well as further objects and advantages, are attained by the present invention which may be described briefly as a display stand capable of being erected from a substantially flat storage and shipping configuration to a display configuration for displaying a card-like item, such as a photograph, the display stand comprising: a substantially flat sheet member extending longitudinally between a first end and a second end, and laterally between opposite side edges; an altitudinal shoulder on the sheet member adjacent the first end thereof, the shoulder extending laterally across the sheet member and extending altitudinally upwardly between the side edges; bend means providing a bend portion in the sheet member extending laterally across the sheet member intermediate the first and second ends and establishing a basal area between the first end and the bend portion; and resilient flexure means providing a resilient flexure portion in the sheet member extending laterally across the sheet member intermediate the bend portion and the second end and establishing a rear wall area between the bend portion and the resilient flexure portion and a front wall area between the resilient flexure portion and the second end; the bend means enabling bending of the sheet member along the bend portion such that the rear wall area will extend altitudinally upwardly from the basal area toward the resilient flexure portion, and the resilient flexure means enabling flexure of the sheet member along the resilient flexure portion such that the front wall area will extend altitudinally downwardly from the resilient flexure portion toward the basal area and bring the second end adjacent the first end, with a confronting portion of the front wall area adjacent the second end confronting and biased resiliently toward the shoulder so that upon juxtaposition of the item with the shoulder and with the confronting portion of the front wall area the item will be gripped between the shoulder and the confronting portion by the resilient bias and held in place for display.

The invention will be understood more fully, while still further objects and advantages will become apparent, in the following detailed description of preferred embodiments illustrated in the accompanying drawing, in which.

Figure 1:
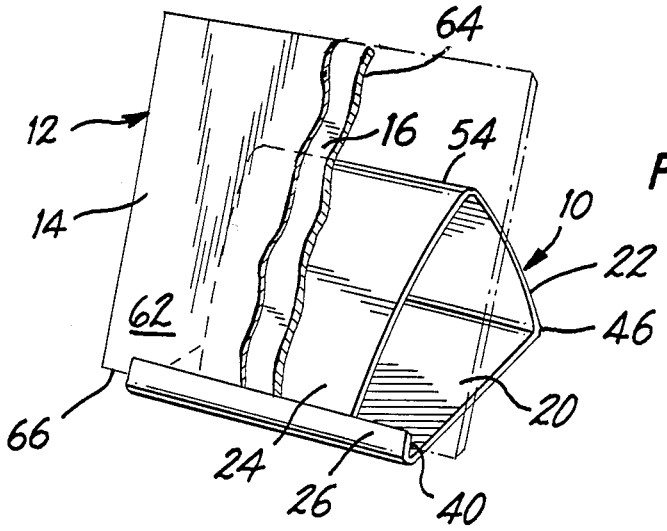
FIG. 1 is a perspective view showing a display stand constructed in accordance with the invention erected and displaying an item.

Referring now to the drawing, and especially to FIG. 1 thereof a display stand constructed in accordance with the invention is illustrated at 10 and is seen displaying a card-like item 12 which, in this instance, is in the form of a photograph 14 adhered to a rigid backing board 16. Display stand 10 has a base 20, a rear wall 22 and a front wall 24. The item 12 is held in place between the front wall 24 and a lip 26 of the display stand 10, in a manner more fully described below.

Figure 2:
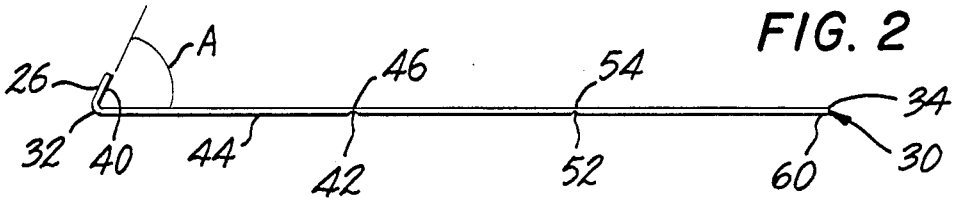
FIG. 2 is a side elevational view of the display stand prior to erection.
Figure 3:
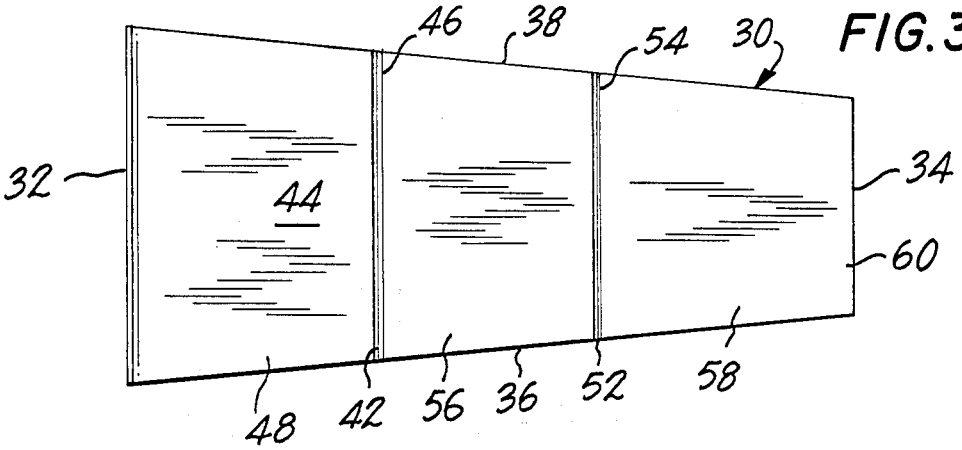
FIG. 3 is a bottom plan view of the display stand prior to erection.

Turning now to FIGS. 2 and 3, display stand 10 is shown in a substantially flat configuration in which configuration the display stand is in condition for ready shipping and compact storage. Thus, prior to erection, display stand 10 is in the form of a flat sheet member 30 extending longitudinally between a first end 32 and a second end 34 and extending laterally between opposite side edges 36 and 38. Lip 26 is located at the first end 32, extends laterally across the sheet member 30 between the opposite side edges 36 and 38, and extends altitudinally upwardly from the sheet member 30 at an acute angle A to provide a relatively shallow shoulder 40 adjacent the first end 32. Bend means is provided in the form of a score line 42 extending laterally across the lower surface 44 of sheet member 30 from one side edge 36 to the other side edge 38, enabling the corresponding bend portion 46 of sheet member 30 to be bent into an essentially permanent bend along score line 42. Thus, the area of the sheet member 30 lying between first end 32 and score line 42 is a basal area 48 which, upon erection of the display stand 10, will become base 20.

Flexure means in the form of further score line 52 extends across sheet member 30, from one side edge 36 to the other side edge 38, along the lower surface 44 and provides a corresponding flexure portion 54 in sheet member 30. Score line 52 is not as wide or as deep as score line 42 so that sheet member 30 merely will flex resiliently at flexure portion 54 and will not bend sharply into a relatively permanent bend, as is formed along score line 42 and bend portion 46. Score line 52 is located longitudinally between score line 42 and second end 34 and defines a rear wall area 56 between score line 42 and score line 52, which rear wall area will become rear wall 22, and a front wall area 58, between score line 52 and second end 34, which will become front wall 24 of the erected display stand 10.

Display stand 10 advantageously is stored and shipped in the flat configuration depicted in FIGS. 2 and 3. In the flat configuration, display stand 10 easily is stacked for storage in a minimum volume. Individual display stands 10 readily are inserted into envelopes for ease of packaging and shipping. For example, a display stand 10, in its flat configuration, readily can be placed into an envelope together with a photograph so that upon arrival at its destination the display stand 10 can be erected and the photograph immediately displayed.

Figure 4:
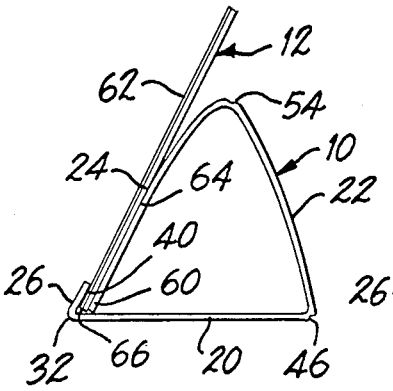
FIG. 4 is a side elevational view of the display stand erected as in FIG. 1.

Erection of the display stand 10 is accomplished with ease. The sheet member 30 is bent along bend portion 46 so that rear wall area 56 extends altitudinally upwardly relative to basal area 48, at the rear boundary of what now becomes base 20. The bend essentially is permanent by virtue of the extent of the score line 42 and the nature of bend portion 46. The front wall area 58 then is directed altitudinally downwardly from flexure portion 54, and forward toward lip 26, so as to pass over base 20, and an end portion 60 confronts and is tucked behind the shoulder 40 to establish a generally triangular cross-sectional configuration, as seen in FIG. 4, the triangular cross-sectional configuration being established by virtue of the relative longitudinal lengths of the basal area 48, the rear wall area 56 and the front wall area 58. Thus, the longitudinal distance between the bend portion 46 and second end 34 is greater than the longitudinal distance between the bend portion 46 and shoulder 40 so that rear wall 22 and front wall 24 extend upwardly from base 20 to an axial upper location portion at the flexure portion 54 to form the triangular cross-sectional configuration. The item 12 to be displayed is placed between the shoulder 40 and end portion 60 with the obverse surface 62 of item 12 facing forward for view. The reverse surface 64 of item 12 rests against front wall 24 of display stand 10 and the lowermost edge 66 of item 12 is seated between shoulder 40 and end portion 60.

The end portion 60 is biased generally forward, toward the shoulder 40, with a resilient biasing force established by the nature of the material of sheet member 30 and flexure portion 54 thereof. The lip 26 is fixed essentially rigidly relative to base 20 of sheet member 30 so as to resist forward movement by the resilient biasing force transmitted through end portion 60. Flexure portion 54 is located at the apex of the triangular cross-sectional configuration of the erected display stand 10 and the resilient biasing force serves to clamp the item 12 in place within the erected display stand 10 with the item 12 canted rearwardly to establish a stable display resting upon base 20. Since shoulder 40 is shallow, only a relatively small area of the obverse surface 62 is covered by lip 26, so that the view of obverse surface 62 is not obscured. Display stand 10 may be made relatively small so that it becomes hidden from view, behind item 12, thereby presenting no visual effect which could conflict with the aesthetics of the item 12 itself.

Figure 5:
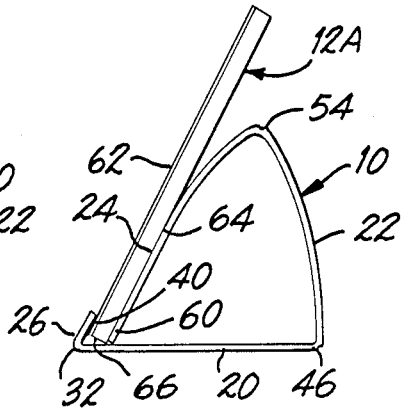
FIG. 5 is a side elevational view similar to FIG. 4, but showing an alternate item being displayed.

Items of various dimensions readily are accommodated in display stand 10. Thus, the lateral width and altitudinal height of item 12 may be varied without affecting the manner in which the item is secured within display stand 10 and supported for display. Hence, oblong items may be displayed in either a vertical or a horizontal orientation. Various thicknesses in the item also are accommodated. While a relatively thin item 12 is shown in FIG. 4, a thicker item 12A is shown in FIG. 5 secured within display stand 10. The thicker item 12A is accommodated merely by movement of the front wall 24 rearwardly to admit item 12A between shoulder 40 and end portion 60. Furthermore, display stand 10 can accommodate a stack of thin items, such as a stack of cards, and as the cards are removed one-by-one from the stack, front wall 24 will move in response to the resilient biasing force to maintain the remaining cards in place within the secured stack.

Figure 6:
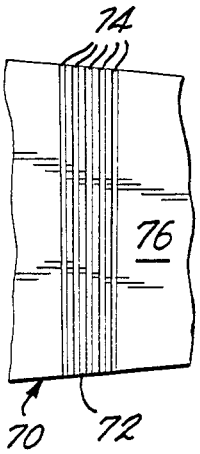
FIG. 6 is a fragmentary bottom plan view of a similar display stand, illustrating an alternate construction.

Turning now to FIG. 6, there is illustrated a fragment of another sheet member 70 constructed similarly to sheet member 30, except that the flexure portion 72 of sheet member 70 is provided by a plurality of score lines 74 extending across the lower surface 76 of sheet member 70. In this manner, the flexure portion 72 is spread over a greater area of sheet member 70 to assure that the flexure of the material of sheet member 70 is maintained resilient to preserve the resilient biasing force which secures an item in the erected display stand.

Sheet member 30 (or 70) preferably is constructed of a synthetic resin material which may be provided with the permanently deformed upwardly directed lip 26 and with the necessary bend portion 46 and flexure portion 54. The material must possess the requisite rigidity to stand up under the load of item 12, and must be resiliently flexible to establish the erected cross-sectional configuration and the clamping forces necessary to retain the item 12 within the display stand 10 for appropriate display. Vinyl-based plastic sheet materials which exhibit the required characteristics are available. One such material is sold under the trademark KYDEX.

Display stand 10 may be constructed in a plurality of different sizes for displaying items of various dimensions. The construction is simple, yet effective, enabling display stand 10 to be manufactured in a single, unitary component part of relatively inexpensive, readily available materials. As can be seen, display stand 10 is erected readily without tools and without requiring special skills. The construction of display stand 10 enables widespread use in many different applications, all with effectiveness and with aesthetic appeal.

It is to be understood that the above detailed description of embodiments of the invention are provided by way of example only. Various details of design and construction may be modified without departing from the true spirit and scope of the invention, as set forth in the appended claims.

The embodiments of the invention in which an exclusive property or privilege is claimed are defined as follows:

1. A display stand capable of being erected from a substantially flat storage and shipping configuration to a display configuration for displaying a card-like item, such as a photograph, the display stand comprising:

a substantially flat sheet member extending longitudinally between a first end and a second end, and laterally between opposite side edges;

an altitudinal shoulder on the sheet member adjacent the first end thereof, said shoulder extending laterally across the sheet member and extending altitudinally upwardly between the side edges;

bend means providing a bend portion in the sheet member extending laterally across the sheet member intermediate the first and second ends and establishing a basal area between the first end and the bend portion; and resilient flexure means providing a resilient flexure portion in the sheet member extending laterally across the sheet member intermediate the bend portion and the second end and establishing a rear wall area between the bend portion and the resilient flexure portion and a front wall area between the resilient flexure portion and the second end;

said bend means enabling bending of the sheet member along the bend portion such that the rear wall area will extend altitudinally upwardly from the basal area toward the resilient flexure portion, and said resilient flexure means enabling flexure of the sheet member along the resilient flexure portion such that the front wall area will extend altitudinally downwardly from the resilient flexure portion toward the basal area and bring the second end adjacent the first end, with a confronting portion of the front wall area adjacent the second end confronting and biased resiliently toward said shoulder so that upon juxtaposition of said item with the shoulder and with said confronting portion of the front wall area the item will be gripped between the shoulder and said confronting portion by said resilient bias and held in place for display.

2. The invention of claim 1 wherein the distance between the bend portion and the second end is greater than the distance between the bend portion and the shoulder such that the basal area, the rear wall area and the front wall area will extend along a generally triangular cross-sectional configuration upon erection of the display stand.

3. The invention of claim 1 wherein the bend portion includes a score line extending laterally across the sheet member, the score line having a depth and width enabling the establishment of a permanent bend in the sheet member upon said bending of the sheet member along the bend portion.

4. The invention of claim 3 wherein the resilient flexure portion includes at least one score line extending laterally across the sheet member, said flexure portion score line having a depth and a width enabling resilient flexure of the sheet member along the flexure portion.

5. The invention of claim 4 wherein the distance between the bend portion and the second end is greater than the distance between the bend portion and the shoulder such that the basal area, the rear wall area and the front wall area will extend along a generally triangular cross-sectional configuration upon erection of the display stand.

6. The invention of claim 4 wherein the sheet member is constructed of a vinyl-based synthetic resin material.

7. The invention of claim 3 wherein the resilient flexure portion includes a plurality of score lines extending laterally across the sheet member, said flexure portion score lines each having a depth and a width enabling resilient flexure of the sheet member along the flexure portion.

8. The invention of claim 7 wherein the distance between the bend portion and the second end is greater than the distance between the bend portion and the shoulder such that the basal area, the rear wall area and the front wall area will extend along a generally triangular cross-sectional configuration upon erection of the display stand.

9. The invention of claim 8 wherein the sheet member is constructed of a vinyl-based synthetic resin material.

10. The invention of claim 1 wherein the sheet member includes a lip adjacent the first end, the lip extending laterally across the sheet member between the side edges and projecting altitudinally upwardly, said shoulder being located on said lip.

11. The invention of claim 10 wherein the lip projects upwardly at an acute angle with the basal area of the sheet member.

12. The invention of claim 11 wherein the distance between the bend portion and the second end is greater than the distance between the bend portion and the shoulder such that the basal area, the rear wall area and the front wall area will extend along a generally triangular cross-sectional configuration upon erection of the display stand.

13. The invention of claim 12 wherein the sheet member is constructed of a vinyl-based synthetic resin material.

14. A display stand for displaying a card-like item, such as a photograph, the display stand comprising:

a sheet member having opposite side edges and first and second ends;

a shoulder on the sheet member adjacent the first end thereof, said shoulder extending laterally across the sheet member between said opposite side edges, and extending altitudinally upwardly;

a rear boundary in said sheet member, said rear boundary extending laterally across the sheet member between said opposite side edges and being spaced longitudinally from the first end;

a base on said sheet member, said base extending between the first end and the rear boundary;

a rear wall on said sheet member, said rear wall extending altitudinally upwardly from said rear boundary to an upper portion of said sheet member;

a front wall on said sheet member, said front wall extending altitudinally downwardly from the upper portion of the sheet member toward said shoulder, said front wall including a confronting portion adjacent the second end of the sheet member and confronting said shoulder;

said sheet member being resiliently flexible along the upper portion thereof such that the front wall portion is biased toward the shoulder with a resilient biasing force so that upon juxtaposition of said item with said shoulder and said confronting portion of the front wall, the item will be gripped between the shoulder and the confronting portion and held by said resilient biasing force in place for display.

15. The invention of claim 14 including a bend in said sheet member, said bend extending laterally across the sheet member along the rear boundary.

16. The invention of claim 14 including resilient flexure means located at upper portion of said sheet member, said resilient flexure means establishing said resilient biasing force.

17. The invention of claim 16 including a bend in said sheet member, said bend extending laterally across the sheet member along the rear boundary.

18. The invention of claim 17 wherein said shoulder, said base, said rear wall and said front wall all are unitary with said sheet member.

19. The invention of claim 18 including a lip unitary with the sheet member adjacent the first end, the lip extending laterally across the sheet member between the side edges and projecting altitudinally upwardly toward the upper portion of the sheet member, said shoulder being located on said lip.

20. The invention of claim 19 wherein the rear wall extends upwardly from the base at an acute angle and the front wall extends upwardly from the base at an acute angle whereby the base, the rear wall and the front wall extend along a generally triangular cross-sectional configuration.

* * * * *